US010429106B2

(12) United States Patent
Christians et al.

(10) Patent No.: US 10,429,106 B2
(45) Date of Patent: Oct. 1, 2019

(54) ASYMMETRIC EVAPORATOR

(71) Applicant: Carrier Corporation, Farmington, CT (US)

(72) Inventors: Marcel Christians, Skaneateles, NY (US); Jack Leon Esformes, Jamesville, NY (US); Satyam Bendapudi, Fayetteville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 215 days.

(21) Appl. No.: 15/101,050

(22) PCT Filed: Oct. 2, 2014

(86) PCT No.: PCT/US2014/058723
§ 371 (c)(1),
(2) Date: Jun. 2, 2016

(87) PCT Pub. No.: WO2015/084482
PCT Pub. Date: Jun. 11, 2015

(65) Prior Publication Data

US 2016/0305695 A1 Oct. 20, 2016

Related U.S. Application Data

(60) Provisional application No. 61/911,707, filed on Dec. 4, 2013.

(51) Int. Cl.
*F25B 39/02* (2006.01)
*F28D 3/02* (2006.01)
(Continued)

(52) U.S. Cl.
CPC ..... *F25B 39/00* (2013.01); *F25B 39/02* (2013.01); *F28D 3/02* (2013.01); *F28D 7/16* (2013.01);
(Continued)

(58) Field of Classification Search
CPC .... F25B 2339/0242; F28D 3/02; F28F 25/08; F28F 25/082; F28F 25/087
See application file for complete search history.

(56) References Cited

U.S. PATENT DOCUMENTS 5,558,273 A 9/1996 Swenson et al.
2008/0148767 A1 6/2008 De Larminat et al.
(Continued)

FOREIGN PATENT DOCUMENTS

CN 101855502 A 10/2010
CN 201852512 U 6/2011
(Continued)

OTHER PUBLICATIONS

JP2002333236, Machine Translation, Espacenet Patent Search.*
(Continued)

*Primary Examiner* — Edward F Landrum
*Assistant Examiner* — Daniel C Comings
(74) *Attorney, Agent, or Firm* — Cantor Colburn LLP

(57) ABSTRACT

A falling film evaporator includes an evaporator housing and a plurality of evaporator tubes disposed in the evaporator housing and arranged into one or more tube bundles, through which a volume of thermal energy transfer medium is flowed. A plurality of tube sheets support the plurality of evaporator tubes. A first wall member and a second wall member extend vertically at opposite lateral sides of the plurality of evaporator tubes. The first wall member and the second wall member define an inner vapor passage therebetween, define a first outer vapor passage between the first wall member and the evaporator housing, and define a second outer vapor passage between the second wall member and the evaporator housing. A first gap between a first wall member lower edge and the plurality of tube sheets is
(Continued)

greater than second gap between a second wall member lower edge and the plurality of tube sheets.

12 Claims, 4 Drawing Sheets

(51) Int. Cl.

| | |
|---|---|
| ***F28F 25/08*** | (2006.01) |
| ***F25B 39/00*** | (2006.01) |
| ***F28D 7/16*** | (2006.01) |
| ***F28D 21/00*** | (2006.01) |
| ***F28F 9/02*** | (2006.01) |

(52) U.S. Cl.
CPC ..... *F28D 7/1661* (2013.01); *F28D 21/0017* (2013.01); *F28F 9/027* (2013.01); *F28F 25/08* (2013.01); *F25B 2339/0242* (2013.01); *F28F 25/082* (2013.01); *F28F 25/087* (2013.01)

(56) References Cited

U.S. PATENT DOCUMENTS

2010/0276130 A1* 11/2010 de Larminat ..... F25B 39/028 165/157
2011/0056664 A1 3/2011 Larminat et al.

FOREIGN PATENT DOCUMENTS

| | | | |
|---|---|---|---|
| CN | 202885362 | U | 4/2013 |
| JP | 2002333236 | A | 11/2002 |
| WO | 2013074749 | A1 | 5/2013 |

OTHER PUBLICATIONS

Notification of Transmittal of the International Search Report and the Written Opinion of the International Searching Authority, or the Declaration; Application No. PCT/US2014/058723; dated Dec. 18, 2014; 9 pages.
Chinese Office Action Issued in CN Application No. 201480074917.4, dated Dec. 14, 2017, 8 Pages.

* cited by examiner

ASYMMETRIC EVAPORATOR

BACKGROUND

The subject matter disclosed herein relates to heating, ventilation and air conditioning (HVAC) systems. More specifically, the subject matter disclosed herein relates to evaporators for HVAC systems.

HVAC systems, such as chillers, use an evaporator to facilitate a thermal energy exchange between a refrigerant in the evaporator and a medium flowing in a number of evaporator tubes positioned in the evaporator. In a flooded evaporator, the tubes are submerged in a pool of refrigerant. In the flooded evaporator system, compressor guide vanes and system metering tools control a total rate of refrigerant circulation through the system. The specific requirement of maintaining an adequate refrigerant level in the pool is achieved by merely maintaining a level of charge, or total volume of refrigerant in the system.

Another type of evaporator used in chiller systems is a falling film evaporator. In a falling film evaporator, bundles or groups of evaporator tubes are positioned typically below a distribution manifold from which refrigerant is urged, forming a "falling film" on the evaporator tubes. The falling film terminates in a refrigerant pool at a bottom of the falling film evaporator. In normal typical evaporator construction, the evaporator tubes are supported by a number of support sheets spaced along the length of the tubes, and are partially enclosed in a sheath along a length of the tubes. The sheath forces vapor generated by the evaporator tubes downward toward the refrigerant pool, where it mixes with vapor from the refrigerant pool and changes direction, flowing upward to a suction nozzle. Even after directing the vapor downwardly via the sheath, undesirable amounts of liquid refrigerant entrained in the vapor makes its way to the suction nozzle and consequently to the compressor, where it has a negative impact on compressor performance.

BRIEF SUMMARY

In one embodiment, a falling film evaporator for a heating ventilation and air conditioning (HVAC) system includes an evaporator housing and a plurality of evaporator tubes disposed in the evaporator housing and arranged into one or more tube bundles, through which a volume of thermal energy transfer medium is flowed. A plurality of tube sheets support the plurality of evaporator tubes. A first wall member and a second wall member extend vertically at opposite lateral sides of the plurality of evaporator tubes. The first wall member and the second wall member define an inner vapor passage therebetween, define a first outer vapor passage between the first wall member and the evaporator housing, and define a second outer vapor passage between the second wall member and the evaporator housing. A first gap between a first wall member lower edge and the plurality of tube sheets is greater than second gap between a second wall member lower edge and the plurality of tube sheets.

In another embodiment, a heating, ventilation and air conditioning (HVAC) system includes a condenser flowing a flow of refrigerant therethrough, a compressor in flow communication with the condenser, and a falling film evaporator in flow communication with the condenser via refrigerant inlet and in flow communication with the compressor via a vapor outlet. The falling film evaporator includes an evaporator housing and a plurality of evaporator tubes disposed in the evaporator housing and arranged into one or more tube bundles, through which a volume of thermal energy transfer medium is flowed. A plurality of tube sheets support the plurality of evaporator tubes. A first wall member and a second wall member extend vertically at opposite lateral sides of the plurality of evaporator tubes. The first wall member and the second wall member define an inner vapor passage therebetween, define a first outer vapor passage between the first wall member and the evaporator housing, and define a second outer vapor passage between the second wall member and the evaporator housing. A first gap between a first wall member lower edge and the plurality of tube sheets is greater than second gap between a second wall member lower edge and the plurality of tube sheets.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
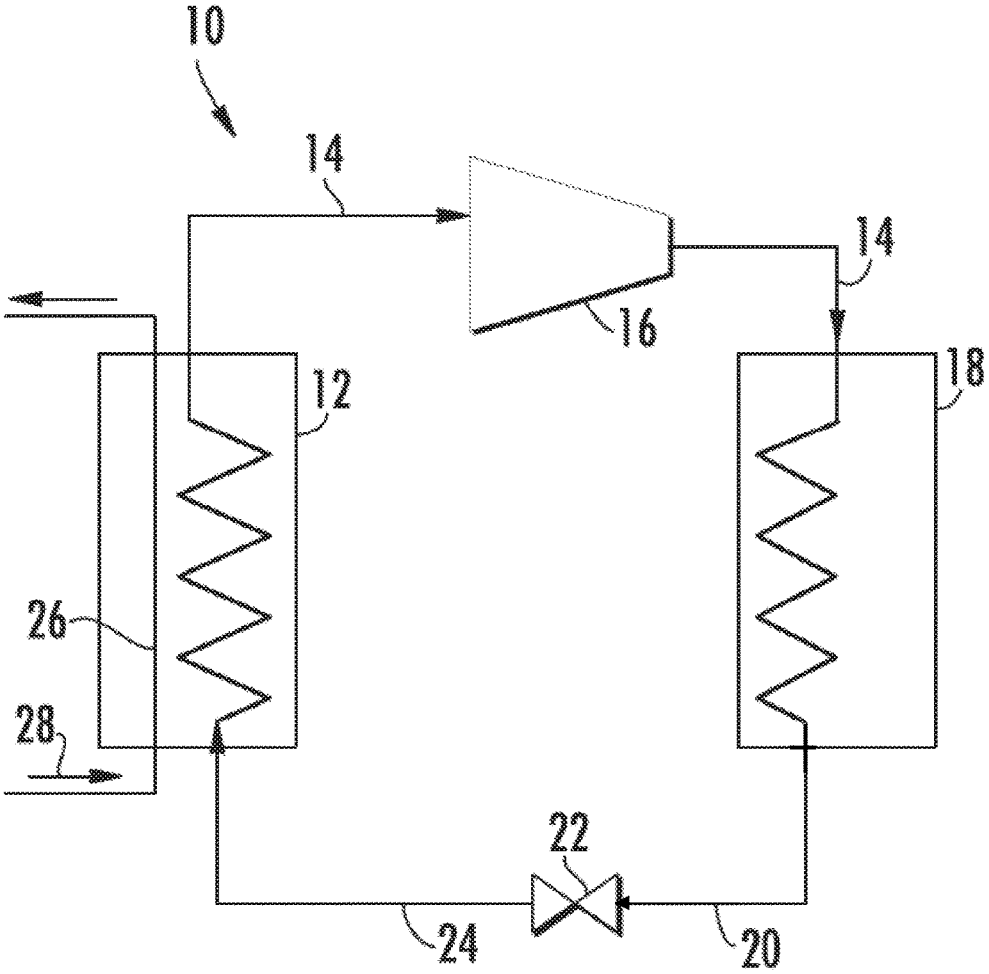
FIG. 1 is a schematic view of an embodiment of a heating, ventilation and air conditioning system.

The detailed description explains embodiments of the invention, together with advantages and features, by way of example with reference to the drawing.

DETAILED DESCRIPTION

Shown in FIG. 1 is a schematic view of an embodiment of a heating, ventilation and air conditioning (HVAC) unit, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 to the evaporator 12. A thermal energy exchange occurs between a flow of heat transfer medium 28 flowing through a plurality of evaporator tubes 26 into and out of the evaporator 12 and the vapor and liquid refrigerant mixture 24. As the vapor and liquid refrigerant mixture 24 is boiled off in the evaporator 12, the vapor refrigerant 14 is directed to the compressor 16.

Figure 2:
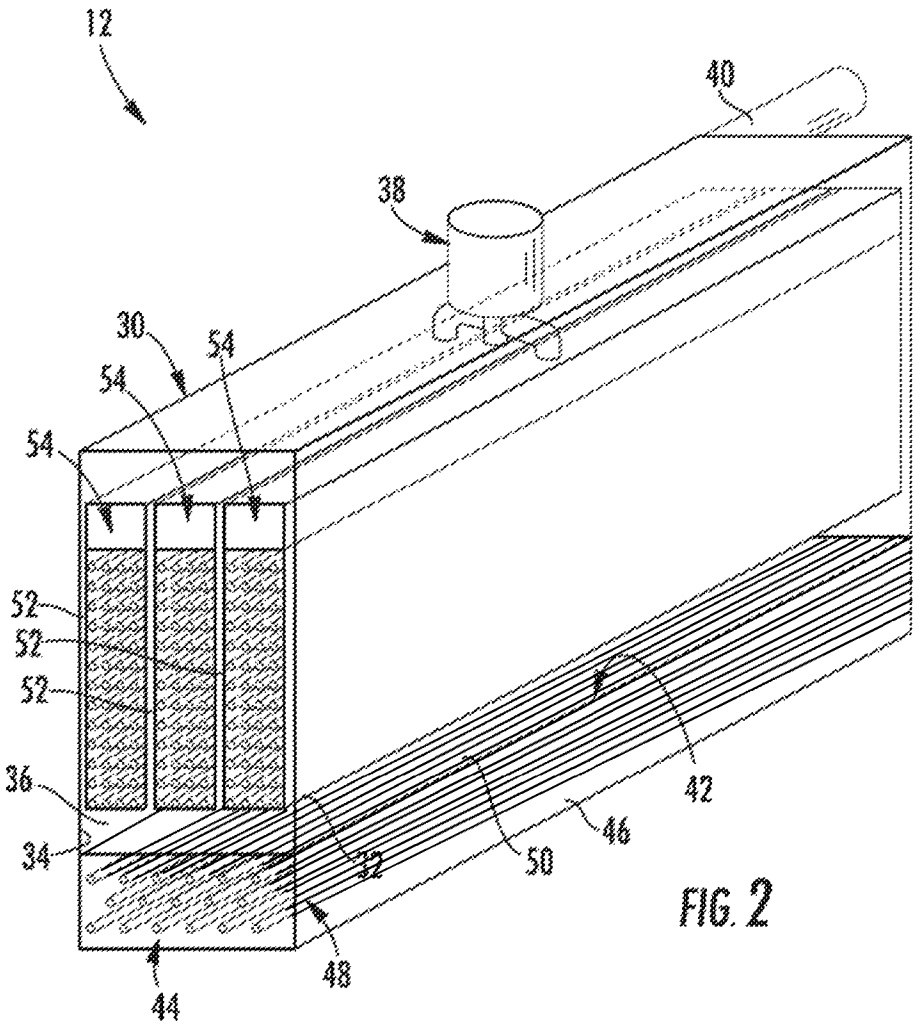
FIG. 2 is a schematic view of an embodiment of a falling film evaporator for an HVAC system.

Referring now to FIG. 2, as stated above, the evaporator 12 is a falling film evaporator. The evaporator 12 includes a shell 30 having an outer surface 32 and an inner surface 34 that define a heat exchange zone 36. In the exemplary embodiment shown, shell 30 includes a non-circular cross-section. As shown, shell 30 includes a rectangular cross-section however, it should be understood that shell 30 can take on a variety of forms including both circular and non-circular. Shell 30 includes a refrigerant inlet 38 that is configured to receive a source of refrigerant (not shown). Shell 30 also includes a vapor outlet 40 that is configured to connect to an external device such as the compressor 16. Evaporator 12 is also shown to include a refrigerant pool zone 42 arranged in a lower portion of shell 30. Refrigerant pool zone 42 includes a pool tube bundle 44 that circulates a fluid through a pool of refrigerant 46. Pool of refrigerant 46 includes an amount of liquid refrigerant 48 having an upper surface 50. The fluid circulating through the pool tube bundle 44 exchanges heat with pool of refrigerant 46 to convert the amount of refrigerant 48 from a liquid to a vapor state. In some embodiments, the refrigerant may be a "low pressure refrigerant" defined as a refrigerant having a liquid phase saturation pressure below about 45 psi (310.3 kPa) at 104° F. (40° C.). An example of low pressure refrigerant includes R245fa.

Figure 3:
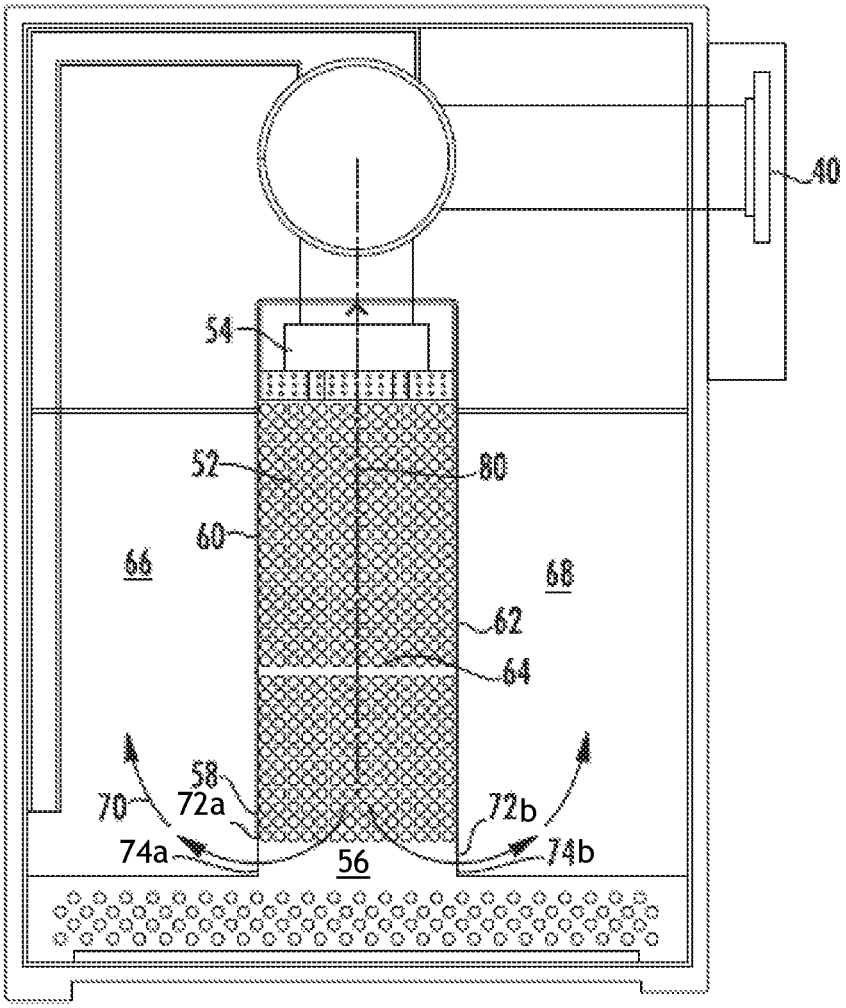
FIG. 3 is a cross-sectional view of an embodiment of a falling film evaporator.

In accordance with the exemplary embodiment shown, evaporator 12 includes one or more tube bundles 52, or groups of tubes 26, that provide a heat exchange interface between refrigerant and another fluid. Each tube bundle 52 may include a corresponding refrigerant distributor 54. Refrigerant distributors 54 provide a uniform distribution of refrigerant onto tube bundles 52 respectively. As will become more fully evident below, refrigerant distributors 54 deliver a refrigerant onto the corresponding tube bundles 52. In some embodiments, as shown in FIG. 2, the evaporator 12 may have 3 tube bundles 52 and three refrigerant distributors 54, while in other embodiments, such as shown in FIG. 3, the evaporator may have a single tube bundle 52. Further, in some embodiments, the quantities of refrigerant distributors 54 and tube bundles 52 are unequal. For example, and evaporator 12 may include two refrigerant distributors 54 and three tube bundles 52 over which the two refrigerant distributors 54 flow refrigerant.

The tube bundles 52 and the pool tube bundle 44 are supported in the evaporator 12 by a plurality of tube sheets 56 fixed in the shell 30 and having tube openings through which the pool tube bundle 44 and tube bundles 52 extend thereby retaining them. The tube bundles 52 are partially contained in a sheath 58 having wall members 60 and 62, defining inner vapor passage 64 between the wall members 60 and 62, first outer vapor passage 66 between the wall member 60 and the inner surface 34, and second outer vapor passage 68 between the wall member 62 and the inner surface 34. As the vapor and liquid refrigerant mixture 24 is flowed over the tube bundle 52, a portion of the mixture 24 is turned to vapor, and the vapor refrigerant 70 is forced to flow downwardly in the inner vapor passage 64 due to the presence of the wall members 60 and 62. Upon reaching a bottom edge 72*a* of wall member 60 and bottom edge 72*b* of wall member 62, the vapor refrigerant 70 flows through a gap 74*a* between the bottom edge 72*a* and the tube sheet 56 and through a gap 74*b* between the bottom edge 72*b* and the tube sheet 56, and upwardly toward the vapor outlet 40 via outer vapor passages 66 and 68.

Figure 4:
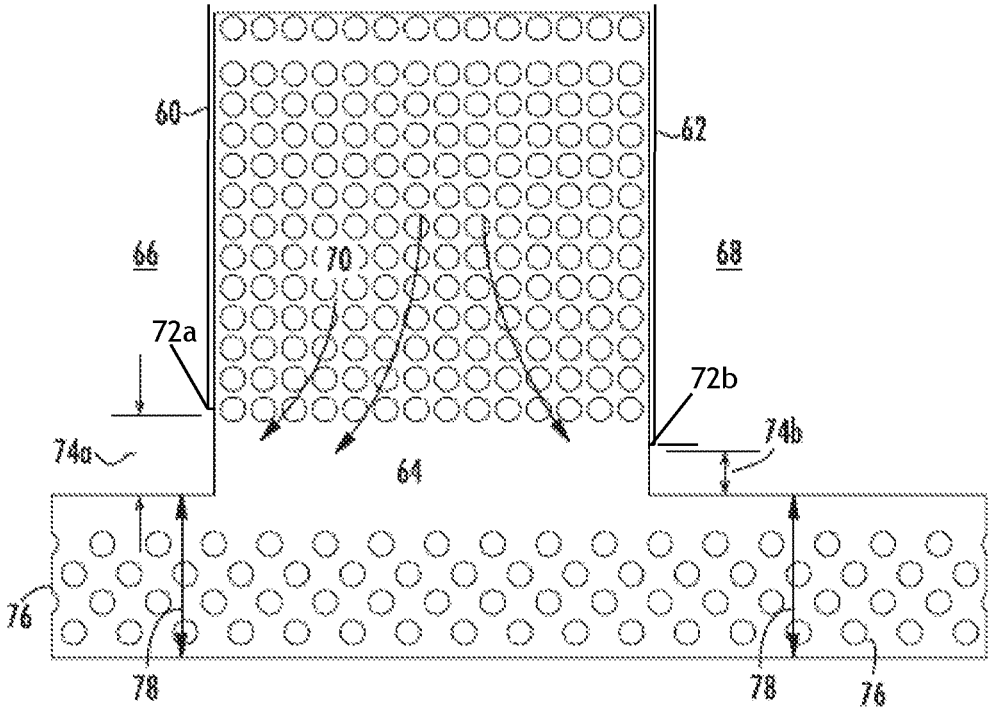
FIG. 4 is another cross-sectional view of an embodiment of a support sheet for an evaporator of an HVAC system.

To reduce the amount of entrained liquid refrigerant in the vapor refrigerant 70 flowing through the vapor outlet 40, it is desired to bias the flow of vapor refrigerant 70 exiting the inner vapor passage 64 into the first outer vapor passage 66, furthest from the vapor outlet 40. This results in a longer path for vapor refrigerant 70 flow to reach the vapor outlet 40, thereby decreasing the amount of entrained liquid refrigerant mixed with the vapor refrigerant 70. One embodiment, illustrated in FIG. 4, achieves this bias by utilizing wall members 60 and 62 of unequal length. The second wall member 62 is longer than the first wall member 60, so that the gap 74*a* into the first outer vapor passage 66 is larger than the gap 74*b* into the second outer vapor passage 68. In an alternative embodiment, the unequal gaps are achieved not by having wall members 60, 62 of unequal length, but by having tube sheet bases 76 of unequal height 78. Finally, the unequal gaps 74*a*, 74*b* may be achieved by combinations of these two. In some embodiments, the size difference between gap 74*a* and gap 74*b* is about 1 inch. In some embodiments, gap 74*b* is closer to the evaporator suction line (e.g., outlet) than gap 74*a*, to bias vapor flow towards the side opposite the evaporator suction line and reduce the risk of liquid carry-over into the suction line due to vapor mal-distribution.

Other asymmetric constructions of the evaporator 12 may be used to bias the flow of vapor refrigerant 70. For example, the evaporator 12 may be defined with a lateral axis 80 bisecting the evaporator 12. In some embodiments, the position of the tube bundle 52 with respect to the lateral axis 80 is shifted such that there are fewer tubes 26 at the side of the lateral axis 80 closest to the vapor outlet 40, compared to a number of tubes 26 at the side of the lateral axis 80 farthest from the vapor outlet 40. Wall members 60 and 62 are also correspondingly shifted relative to the lateral axis 80.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A falling film evaporator for a heating ventilation and air conditioning (HVAC) system comprising:

an evaporator housing;

a plurality of evaporator tubes disposed in the evaporator housing and arranged into one or more tube bundles, through which a volume of thermal energy transfer medium is flowed;

a plurality of tube sheets supportive of the plurality of evaporator tubes;

a first wall member and a second wall member extending vertically at opposite lateral sides of the plurality of evaporator tubes, the first wall member and the second wall member defining an inner vapor passage therebetween, defining a first outer vapor passage between the first wall member and the evaporator housing, and defining a second outer vapor passage between the second wall member and the evaporator housing; and a vapor outlet disposed at an evaporator housing wall to direct vapor refrigerant from the evaporator housing;

wherein a first gap between a first wall member lower edge and a tube sheet base of the plurality of tube sheets is greater than a second gap between a second wall member lower edge and the tube sheet base of the plurality of tube sheets; and wherein the second gap is disposed nearer to the vapor outlet than the first gap, biasing the flow of vapor refrigerant from the plurality of evaporator tubes toward a lateral side of the evaporator opposite the vapor outlet, thereby decreasing an amount of entrained liquid refrigerant in the flow of vapor refrigerant reaching the vapor outlet.

2. The falling film evaporator of claim 1, wherein the first wall member is vertically shorter than the second wall member.

3. The falling film evaporator of claim 1, wherein a height of a tube sheet base at the first gap is lower than a height of a tube sheet base at the second gap.

4. The falling film evaporator of claim 1, wherein a first distance from the first wall member to the vapor outlet of the falling film evaporator is greater than a second distance from the second wall member to the vapor outlet.

5. The falling film evaporator of claim 1, wherein a difference between the first gap and the second gap is 1 inch.

6. The falling film evaporator of claim 1, further comprising a vertically extending axis bisecting the evaporator housing, wherein fewer evaporator tubes are disposed at a first side of the vertically extending axis than disposed at a second side of the vertically extending axis.

7. A heating, ventilation and air conditioning (HVAC) system comprising:

a condenser flowing a flow of refrigerant therethrough;

a compressor in flow communication with the condenser;

a falling film evaporator in flow communication with the condenser via refrigerant inlet and in flow communication with the compressor via a vapor outlet including:

an evaporator housing;

a plurality of evaporator tubes disposed in the evaporator housing and arranged into one or more tube bundles, through which a volume of thermal energy transfer medium is flowed;

a plurality of tube sheets supportive of the plurality of evaporator tubes;

a first wall member and a second wall member extending vertically at opposite lateral sides of the plurality of evaporator tubes, the first wall member and the second wall member defining an inner vapor passage therebetween, defining a first outer vapor passage between the first wall member and the evaporator housing, and defining a second outer vapor passage between the second wall member and the evaporator housing; and a vapor outlet disposed at an evaporator housing wall to direct vapor refrigerant from the evaporator housing;

wherein a first gap between a first wall member lower edge and a tube sheet base of the plurality of tube sheets is greater than a second gap between a second wall member lower edge and the tube sheet base of the plurality of tube sheets; and wherein the second gap is disposed nearer to the vapor outlet than the first gap thereby biasing the flow of vapor refrigerant from the plurality of evaporator tubes toward a lateral side of the evaporator opposite the vapor outlet, thereby decreasing an amount of entrained liquid refrigerant in the flow of vapor refrigerant reaching the vapor outlet.

8. The HVAC system of claim 7, wherein the first wall member is vertically shorter than the second wall member.

9. The HVAC system of claim 7, wherein a height of a tube sheet base at the first gap is lower than a height of a tube sheet base at the second gap.

10. The HVAC system of claim 7, wherein a first distance from the first wall member to the vapor outlet of the falling film evaporator is greater than a second distance from the second wall member to the vapor outlet.

11. The HVAC system of claim 7, wherein a difference between the first gap and the second gap is 1 inch.

12. The HVAC system of claim 7, further comprising a vertically extending axis bisecting the evaporator housing, fewer evaporator tubes are disposed at a first side of the vertically extending axis than disposed at a second side of the vertically extending axis.

* * * * *